US005899974A

United States Patent [19]

Corwin et al.

[11] Patent Number: 5,899,974

[45] Date of Patent: May 4, 1999

[54] COMPRESSING SPEECH INTO A DIGITAL FORMAT

[75] Inventors: Susan J. Corwin, Portland, Oreg.; David J. Kaplan, Santa Clara, Calif.; Thomas D. Fletcher, Portland, Oreg.

[73] Assignee: Intel Corporation, Santa Clara, Calif.

[21] Appl. No.: 08/775,786

[22] Filed: Dec. 31, 1996

[51] Int. Cl.[6] ..... G10L 5/00

[52] U.S. Cl. ..... 704/258; 704/203; 704/205; 704/211; 704/270

[58] Field of Search ..... 704/258, 203, 704/205, 211, 208, 251, 236, 260, 212, 270

[56] References Cited

U.S. PATENT DOCUMENTS

| | | | |
|---|---|---|---|
| 3,703,609 | 11/1972 | Gluth | 704/258 |
| 4,383,135 | 5/1983 | Scott et al. | 704/236 |
| 4,433,434 | 2/1984 | Mozer | 704/211 |
| 4,577,343 | 3/1986 | Oura | 704/258 |
| 4,752,953 | 6/1988 | Paik et al. | 380/9 |
| 4,888,806 | 12/1989 | Jenkin et al. | 704/270 |
| 5,155,772 | 10/1992 | Brandman et al. | 704/203 |
| 5,448,679 | 9/1995 | McKiel, Jr. | 704/208 |
| 5,640,490 | 6/1997 | Hansen et al. | 704/251 |
| 5,687,191 | 11/1997 | Lee et al. | 375/216 |
| 5,696,879 | 12/1997 | Cline et al. | 704/260 |
| 5,701,391 | 12/1997 | Pan et al. | 704/212 |

*Primary Examiner*—David R. Hudspeth
*Assistant Examiner*—Vijay B. Chawan
*Attorney, Agent, or Firm*—Blakely, Sokoloff, Taylor & Zafman LLP

[57] ABSTRACT

A method for compressing speech. An audio signal comprising speech is broken down into its phonetic components. These phonetic components are then converted into data elements that represent each of the phonetic components. The determination of data elements is accomplished using a predefined table that correlates phonetic sounds to data elements. The data elements representing the phonetic sounds are then stored.

15 Claims, 3 Drawing Sheets

| Data Element | Phonetic Sounds |
|---|---|
| 00000000 | a (fat) |
| 00000001 | ā (fate) |
| 00000010 | ä̇ (far) |
| 00000011 | â (fall) |
| 00000100 | ȧ (ask) |
| 00000101 | b (bat) |
| 00000110 | ch (chair) |
| 00000111 | d (day) |
| 00001000 | e (met) |
| 00001001 | ē (mete) |
| 00001010 | ə (label) |
| 00001011 | f (fill) |
| 00001100 | g (go) |
| • | • |
| • | • |
| • | • |

FIG. 3

COMPRESSING SPEECH INTO A DIGITAL FORMAT

FIELD OF THE INVENTION

The present invention relates to signal compression and more particularly to a method for compressing an audio signal that corresponds to speech.

BACKGROUND OF THE INVENTION

Signal compression is the translating of a signal from a first form to a second form wherein the second form is typically more compact (either in terms of data storage volume or transmission bandwidth) and easier to handle. The second form is then used as a convenient representation of the first form. For example, suppose the water temperature of a lake is logged into a notebook every 5 minutes over the course of a year, generating thousands of pages of raw data. After the information is collected, however, a summary report is produced that contains the average water temperature calculated for each month. This summary report contains only twelve lines of data, one average temperature for each of the twelve months.

The summary report is a compressed version of the thousands of pages of raw data because the summary report can be used as a convenient representation of the raw data. The summary report has the advantage of occupying very little space (i.e. it has a small data storage volume) and can be transmitted from a source, such as a person, to a destination, such as a computer database, very quickly (i.e. it has a small transmission bandwidth).

Sound, too, can be compressed. An audio signal comprising spoken words (speech) comprises continuous waveforms that are constantly changing. The signal is compressed into a digital format by a process known as sampling. Sampling an audio signal involves measuring the amplitude of the analog waveform at discrete intervals in time, and assigning a digital (binary) value to the measured amplitude. This is called analog to digital conversion.

If the time intervals are sufficiently short, and the binary values provide for sufficient resolution, the audio signal can be successfully represented by a finite series of these binary values. There is no need to measure the amplitude of the analog waveform at every instant in time. One need only sample the analog audio signal at certain discrete intervals. In this manner, the continuous analog audio signal is compressed into a digital format that can then be manipulated and played back by an electronic device such as, for example, a computer or a personal digital recorder. In addition, audio signals can be further compressed, once in the digital format, to further reduce the data storage volume and transmission bandwidth to allow, for example, high quality audio signals to be quickly transmitted across even low bandwidth interlinks.

SUMMARY OF THE INVENTION

A method for compressing speech is described. An audio signal comprising speech is broken down into its phonetic components and converted into data elements that represent each of the phonetic components. A table that correlates phonetic sounds to data elements is used to determine the assignment of the data elements to their respective phonetic components. The data elements representing the phonetic sounds are then stored.

Other features and advantages of the present invention will be apparent from the accompanying drawings and the detailed description that follows.

BRIEF DESCRIPTION OF THE DRAWINGS

The present invention is illustrated by way of example and not limitation in the figures of the accompanying drawings in which like references indicate similar elements and in which:

FIG. 3 is a is a table in accordance with one embodiment of the present invention.

DETAILED DESCRIPTION

A method for compressing speech into a digital format is described in which an analog audio signal comprising speech is received. The signal undergoes analog to digital conversion and the resulting digital signal is divided into a series of frames containing pieces of the digital signal that are approximately synchronous.

For each frame, a phonetic sound is identified. The phonetic sounds are then compared between frames to match up phonetic components across multiple frames of the audio signal. Once the phonetic components have been identified, a look-up table is accessed that provides a value (a data element) corresponding to each of the identified phonetic components. These data elements are then stored. For one embodiment of the present invention, information corresponding to amplitude, pitch, and timing of the phonetic components is also stored. In addition, vowel waveforms (including the frequency spectrum, or timbre, of the spoken vowel) contained in the audio signal may also be stored.

In this manner, the analog audio speech signal is highly compressed into a very low bandwidth signal in a digital format. Speech compressed in this manner can be readily transmitted across, for example, even low-bandwidth interlinks such as, for example, phone lines and the internet, and can be easily stored on relatively low capacity storage devices such as, for example, floppy disks or small semiconductor memory devices.

If desired, the audio signal can be reconverted back into an analog signal output that approximates the original analog audio signal input. A voice synthesizer is used to translate the data elements back into the phonetic components using the look-up table, and incorporating the stored amplitude, pitch, and timing information. For an embodiment in which vowel timbre is also stored, the voice synthesizer may use this information to approximate the tonal quality of the original speaker. Alternatively, the data elements representing the phonetic components of the audio signal may be transcribed into a word processor.

Compressing speech into this convenient digital format reduces the need for large memory storage capacity, as is required for speech that has simply been sampled. In addition, in accordance with an embodiment of the present invention there is no need to maintain a large spelling database of words, as is commonly associated with other speech recognition methods, because all words are spelled phonetically. As a result, the form factor of an electronic device such as, for example, a personal digital recorder, can be reduced because the need to provide vast electronic storage capacity is reduced.

The speech compression method is described in more detail below to provide a more thorough description of how to implement an embodiment of the present invention.

Various other configurations and implementations in accordance with alternate embodiments of the present invention are also described in more detail below.

Figure 1:
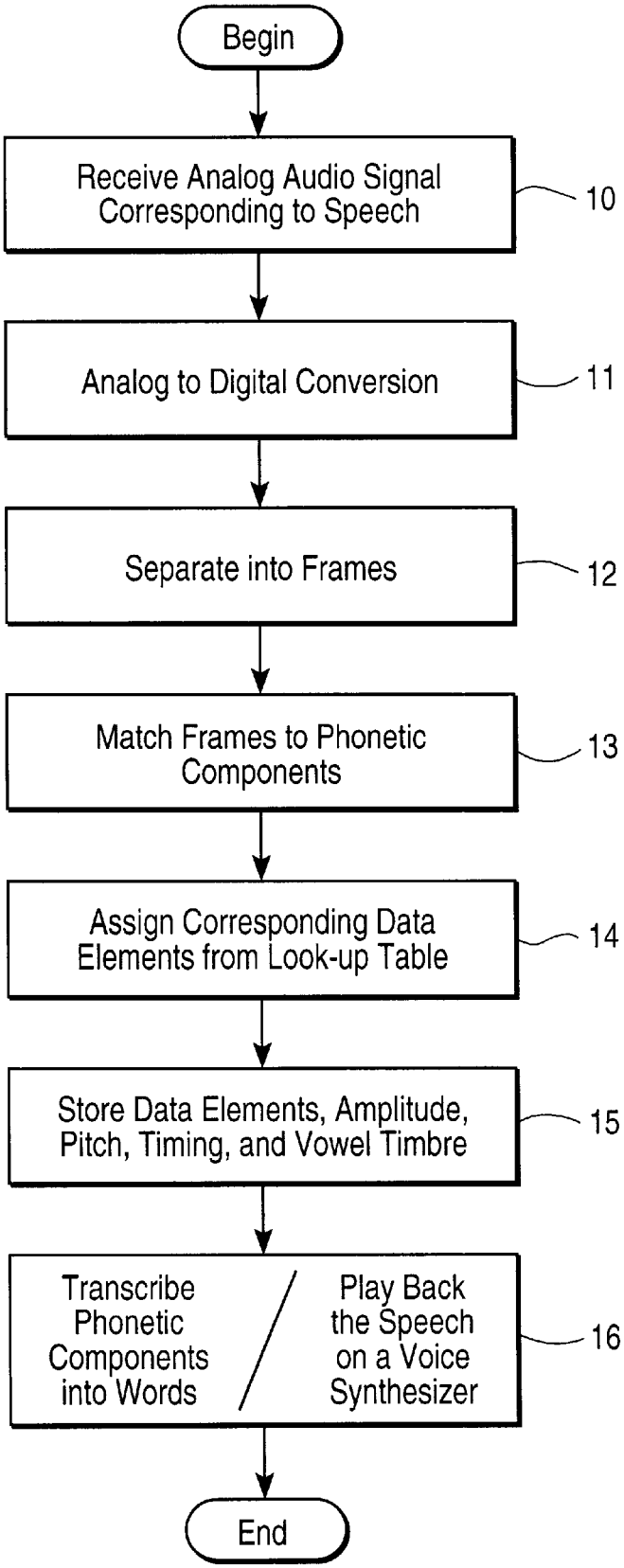
FIG. 1 is a flow chart of a method of one embodiment of the present invention.

FIG. 1 is a flow chart of a method of one embodiment of the present invention. At step 10 an analog audio signal corresponding to the speach of a speaker is received by an electronic device such as, for example, a computer or a personal digital recorder.

At step 11 of FIG. 1, the analog audio signal is converted into a digital signal. In accordance with one embodiment of the present invention, this conversion is done by an analog to digital converter that has a sample rate of approximately 10 KHz with 12-bit resolution. By converting the analog signal to a digital signal in this manner, a sufficient audio frequency bandwidth of up to approximately 5 KHz can be captured with moderate signal to noise ratio. For human speech, a 5 KHz audio spectrum is likely to be sufficient because high frequency harmonics (above approximately 5 KHz) do not typically have a strong presence in the human voice.

For an alternate embodiment of the present invention, a cleaner digital audio signal is obtained by sampling at higher rates with 16-bit or 20-bit resolution. Although this embodiment may provide for a more accurate determination of the phonetic components of the audio signal, there are significantly more memory storage and processing speed requirements associated with such signals. For an alternate embodiment of the present invention in which a digital audio signal is coupled directly to the electronic device that implements the method of the present invention, steps 10 and 11 of FIG. 1 are skipped entirely.

At step 12 of FIG. 1, the digital audio signal stream from step 11 is divided into a series of frames, each frame comprising a number of digital samples from the digital audio signal. Because the entire audio signal is asynchronous (i.e. its waveform changes over time) it is difficult to analyze. This is partially due to the fact that much of the frequency analysis described herein is best done in the frequency domain, and transforming a signal from the time domain to the frequency domain (by, for example, a Fourier transform or discrete cosine transform algorithm) is most ideally done, and in some cases can only be done, on synchronous signals. Therefore, the width of the frames is selected such that the portion of the audio signal represented by the digital samples in each frame is approximately symmetrical (approximately constant over the period of time covered by the frame).

At step 13 of FIG. 1, frames from step 12 are analyzed to determine the phonetic components (the basic phonetic sounds) of the audio signal. The phonetic components can be determined by any of a number of methods, many of which involve analyzing the frequency spectrum of each frame and comparing the results of that analysis across frames to identify characteristic patterns that indicate the phonetic components.

Figure 2:
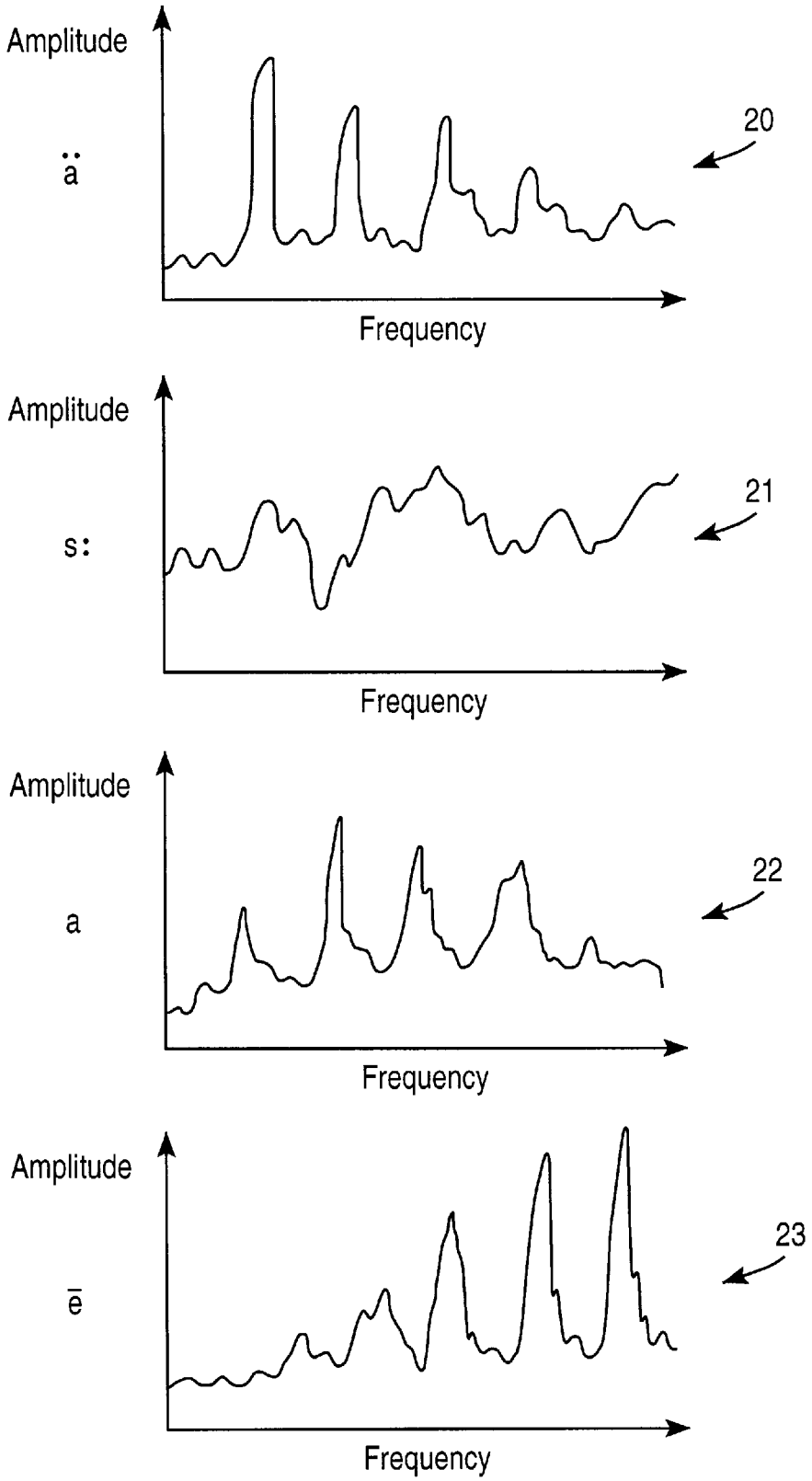
FIG. 2 shows graphs of amplitude versus frequency for various phonetic components in accordance with an embodiment of the present invention.

FIG. 2 shows graphs of amplitude versus frequency for various phonetic components in accordance with an embodiment of the present invention. Each of graphs 20, 21, 22, and 23 corresponds to a particular frame of the digital audio sample. By comparing the frequency spectrum, or timbre, of a frame to the characteristic timbres of known phonetic sounds, the phonetic component in a frame can be identified.

For example, as shown in graph 20, the timbre of this frame has the characteristic of having strong lower harmonics that fall off rapidly toward the upper harmonic range. This characteristic is typical of the phonetic sound "ä" as in "far," and so the phonetic component "ä" is assigned to the frame corresponding to the timbre of FIG. 20. The noisy frequency spectrum pattern shown in FIG. 21 is characteristic of the "s" phonetic sound, and so the phonetic component "s" is assigned to the frame corresponding to the timbre of FIG. 21. Similarly, the frame corresponding to the timbre of FIG. 22 is characteristic of the phonetic sound "a" as in "fat," and the frame corresponding to the timbre of FIG. 23 (having strong upper harmonics) is characteristic of the phonetic sound "e" as in "mete."

For one embodiment of the present invention, comparison of characteristic phonetic sound timbres with the timbre of a particular frame involves a mathematical analysis of calculating the difference between the measured timbre of a frame and the stored characteristic timbres. The phonetic sound corresponding to the least difference between its characteristic timbre and the timbre of the measured frame is matched to the frame. For one embodiment of the present invention, the characteristic timbres of various phonetic sounds are stored in the look-up table described below.

In accordance with one embodiment of the present invention, after phonetic components are matched to a set of frames, adjacent frames are compared to detect any errors in phonetic component matching and to link together any adjacent frames that contain the same calculated phonetic component. For example, for one embodiment of the present invention, a phonetic component that is identified only in a single frame, but not in adjacent frames of the audio signal, is discarded as being a false identification. For another embodiment, a phonetic component that is identified in a first and third frame, but not in the contiguous middle frame, is determined to be a false non-identification, and the phonetic component is added to the middle frame.

Frames are searched backward in time to identify the frame (and, hence, the corresponding time) containing the initial speaker's enunciation of a particular phonetic component, and are searched forward in time to identify the frame (and corresponding time) containing the transition to the next phonetic component. In this manner, determination of the single phonetic component is completed, and this information is stored.

In accordance with step 14 of FIG. 1, the phonetic component determined at step 13 is referenced in a predefined look-up table to determine the corresponding value that is the data element representing the phonetic component of the audio signal. FIG. 3 is a table in accordance with one embodiment of the present invention in which data elements comprising a byte of binary data are assigned to particular phonetic sounds. A sequence of data elements corresponding to a sequence of phonetic components is used to represent the phonetic component sequence (i.e. speech). In this manner, any electronic device with access to a table storing the appropriate associations between data element and phonetic sound can translate the data element sequence back into the phonetic sequence.

For example, the spoken word "elephant" contains seven phonetic components, "e", "l", "e", "f", "e", "n", "t", which, once identified, can be entirely represented by seven bytes from the table of FIG. 3. In comparison, the same word, if sampled for 0.5 seconds at 10 KHz with 12-bit resolution, would occupy [(0.5 sec)×(10 K/sec)×(12 bits)]×(1 byte/8 bits) =7.5 KB of memory space.

For an alternate embodiment of the present invention, the data elements in the table are further compressed using a Huffman compression algorithm so that the most commonly used phonetic components in spoken speech (e.g., the vowels) occupy a smaller number of bits. For this embodiment, more rarely spoken phonetic components such as, for example, "z" as in "zen," occupy a greater number of bits. Also, for an alternate embodiment of the present invention, the table of FIG. 3 additionally includes digital samples of the timbre corresponding to each phonetic sound. This embodiment may be found useful for an embodiment in which playback of the speech is desired, as described below, or for frame timbre to characteristic phonetic sound matching, as described above.

At step 15 of FIG. 1, a data element corresponding to an identified phonetic component, the amplitude (loudness) of the phonetic component, the pitch (fundamental frequency) of the phonetic component, and the timing (e.g. how soon after the previous phonetic component, and for how long, is the current phonetic component spoken) are stored. In accordance with one embodiment of the present invention, the data element, amplitude, pitch, and timing are each a single data element of one byte (8 bits) or one word (16 bits). In addition, for one embodiment of the present invention, the timbre of the speaker's voice for various phonetic vowel components is stored. This timbre information may become useful for an embodiment in which the speaker's voice is to be emulated, as described below.

Upon reaching step 16 of FIG. 1, the speech has been dramatically compressed into a sequence of data elements corresponding to phonetic components of the speech. For one embodiment, amplitude information, pitch information, timing information, or vowel timbre information may also be included in the audio signal. This audio signal can then be transmitted across even a low bandwidth interlink to another electronic device such as, for example, a computer (including personal data assistants) or a personal digital recorder. An interlink includes local area networks, the internet, telephone systems, and any other electronic communication medium. Once received by the electronic device, the electronic device only needs the look-up table to determine how to reconvert the stream of data elements back into phonetic components for playback.

At step 16 of FIG. 1, the compressed audio speech signal is either transcribed or played back. To transcribe the signal, transcription software, with access to the look-up table and to a large database of words, converts the phonetic components into real words. For example, in the above example of the word "elephant", the transcription software receives the data elements representing the phonetic spelling "elefent" and looks up this word in the database to determine that the desired word is "elephant." Transcription of the compressed audio signal is useful for an embodiment of the present invention in which the compression technique describe above is implemented in conjunction with a dictation application.

To play back the speech, the data elements are provided to a voice synthesizer that determines the correlation between the data elements and the phonetic components associated with these elements. Because the audio speech signal is stored phonetically, there is no need for lengthy pronunciation tables to determine how to pronounce a word (as required, for example, when converting ASCII text into speech). In accordance with one embodiment of the present invention, the speech signal is translated and played by the voice synthesizer in a generic tone. For another embodiment of the present invention, the voice synthesizer uses the timbres stored for the particular vowels detected in the audio signal to emulate the original speaker's voice.

In the foregoing specification, the invention has been described with reference to specific exemplary embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A method for compressing speech comprising the steps of:

a. determining a plurality of phonetic components of an audio signal, the audio signal corresponding to speech from a speaker's voice;

b. converting the plurality of phonetic components into a corresponding plurality of data elements selected from a first predefined table that correlates phonetic sounds to data elements;

c. storing the plurality of data elements; and d. storing information that represents a timbre of at least a portion of the plurality of phonetic components that corresponds to vowel sounds for use in emulating the speaker's voice.

2. The method of claim 1, further comprising the step of converting the plurality of data elements into written words in a word processor.

3. The method of claim 1, further comprising the step of converting the plurality of data elements into speech using a voice synthesizer.

4. The method of claim 1, further comprising the step of transmitting the plurality of data elements across an interlink to an electronic device that has access to a second predefined table, the second predefined table corresponding to the first predefined table, the electronic device using the plurality of data elements and the second predefined table to convert the plurality of data elements into speech.

5. The method of claim 1, further comprising the step of storing information that represents a pitch of each of at least a portion of the plurality of phonetic components.

6. The method of claim 1, further comprising the step of storing information that represents an amplitude of each of at least a portion of the plurality of phonetic components.

7. The method of claim 1, further comprising the step of converting the plurality of data elements into speech using a voice synthesizer that emulates the speaker's voice using the information that represents the timbre.

8. The method of claim 1, wherein each of the plurality of data elements is one byte.

9. A method for compressing and decompressing speech comprising the steps of:

determining a plurality of phonetic components of an audio signal that corresponds to speech from a speaker's voice;

converting the plurality of phonetic components into a corresponding plurality of data elements selected from a first predefined table that correlates phonetic sounds to data elements;

converting the plurality of phonetic components into corresponding timbre information;

transmitting the plurality of data elements and timbre information across an interlink to an electronic device having stored therein a second predefined table, the second predefined table corresponding to the first predefined table; and converting the plurality of data elements into speech that emulates the speaker's voice using the plurality of data elements, the timbre information, and the second predefined table.

10. The method of claim 9, further comprising the step of converting the plurality of data elements into written words in a word processor.

11. The method of claim 9, further comprising the step of transmitting information that represents a pitch of each of at least a portion of the plurality of phonetic components across the interlink to the electronic device.

12. The method of claim 9, further comprising the step of transmitting information that represents an amplitude of each of at least a portion of the plurality of phonetic components across the interlink to the electronic device.

13. The method of claim 9, further comprising the step of transmitting across the interlink, to the electronic device, information that represents a timbre of at least a portion of the plurality of phonetic components that corresponds to vowel sounds.

14. The method of claim 13, wherein converting the plurality of data elements into speech is done using a voice synthesizer that emulates a speaker's voice using the information that represents the timbre of vowel sounds.

15. The method of claim 9, wherein each of the plurality of data elements is one byte.

* * * * *